US007931540B2

(12) United States Patent
Lokos

(10) Patent No.: US 7,931,540 B2
(45) Date of Patent: Apr. 26, 2011

(54) CHILDREN'S PLAYLAND

(75) Inventor: Ronald Lokos, Sparta, NJ (US)

(73) Assignee: Moose Mountain Toymakers Ltd., Hong Kong (CN)

( * ) Notice: Subject to any disclaimer, the term of this patent is extended or adjusted under 35 U.S.C. 154(b) by 682 days.

(21) Appl. No.: 11/888,642

(22) Filed: Aug. 1, 2007

(65) Prior Publication Data

US 2008/0129530 A1 Jun. 5, 2008

Related U.S. Application Data

(60) Provisional application No. 60/835,603, filed on Aug. 4, 2006.

(51) Int. Cl.
*A63G 31/12* (2006.01)
*A63G 31/00* (2006.01)

(52) U.S. Cl. ..... 472/134; 472/128; 446/220

(58) Field of Classification Search ..... 472/13, 472/116–117, 128, 129, 134, 136; 446/220–226
See application file for complete search history.

(56) References Cited

U.S. PATENT DOCUMENTS

| | | | | |
|---|---|---|---|---|
| 4,934,079 | A * | 6/1990 | Hoshi | 40/427 |
| 5,316,516 | A * | 5/1994 | Saitoh | 446/175 |
| 6,375,578 | B1 * | 4/2002 | Briggs | 472/117 |
| 6,542,613 | B1 * | 4/2003 | Rieber | 381/124 |
| 6,595,861 | B1 * | 7/2003 | Morrow et al. | 472/134 |
| 6,702,687 | B1 * | 3/2004 | Henry | 472/128 |
| 6,764,408 | B1 * | 7/2004 | Coleman | 472/134 |
| 6,786,793 | B1 * | 9/2004 | Wang | 446/226 |
| 6,878,070 | B1 * | 4/2005 | Wilk | 472/56 |
| 7,364,488 | B2 * | 4/2008 | Mueller et al. | 446/220 |
| 2006/0252563 | A1 * | 11/2006 | Werner | 472/117 |

* cited by examiner

*Primary Examiner* — Kien T Nguyen
(74) *Attorney, Agent, or Firm* — Lerner, David, Littenberg, Krumholz & Mentlik, LLP

(57) ABSTRACT

An inflatable playland for a child is disclosed, as are different embodiments relating to same. The playland may be designed to emulate different objects, and preferably allows for a child to play on or within same. A module or other device is also included to allow the playland to play a sound and/or display a visual upon detection of a child or other object.

27 Claims, 14 Drawing Sheets

CHILDREN'S PLAYLAND

CROSS-REFERENCE TO RELATED APPLICATIONS

This application claims the benefit of the filing date of U.S. Provisional Patent Application No. 60/835,603 filed Aug. 4, 2006, the disclosure of which is hereby incorporated herein by reference.

BACKGROUND OF THE INVENTION

The present invention relates to an inflatable playland for use by a child, and more particularly to an inflatable playland that provides for audible and/or visual enhancement of the playland.

Inflatable toys are well known and very useful tools for keeping a child busy. The ability of such toys to be inflated and deflated allows such toys to not only be fascinating to a child, but also easily packaged and stored in their deflated state. In fact, relatively small packages may contain toys that are very large when inflated. This provides a benefit to both the toy retailer/packager and the end user. Thus, inflatable toys such as beach balls, inflatable characters and the like are very popular toys.

One specific area in which such inflatable technology lends itself particularly well is in big structures or playlands. For example, castles and other enclosures are very popular among children, as such inflatable structures may be designed to be rather large and provide for soft, forgiving surfaces for a child to play on/within. Such inflatable toys may be designed to allow for a child to crawl or walk through one or more passages. This is often very amusing for children, especially those of diminutive size. However, in a world with as much audible and visual stimulation as ours, simple structures such as these may get boring to a child. Simply providing a space for a child to hide or move through is no longer the height of amusement.

Therefore, there exists a need for an inflatable playland capable of keeping the attention of or adding to the amusement of a child.

SUMMARY OF THE INVENTION

A first aspect of the present invention is a playland for use by a person. In accordance with one embodiment of the present invention, the playland includes an inflatable body and a module attached to the body, the module being capable of producing a humanly-perceptible signal upon detection of an object within or near the inflatable body. The humanly-perceptible signal is preferably in the form of an audio signal, a visual signal or a combination of audio and visual signals.

In other embodiments, the inflatable body may include a tunnel portion capable of allowing a person to pass therethrough. The inflatable body may further include a head portion connected to the tunnel portion and a recessed portion connected to the head portion. Although capable of being designed to emulate many different objects, in one embodiment, the inflatable body is designed to emulate an animal such as a puppy.

In other embodiments, the module may be formed integrally with the inflatable body or removably connected thereto. In the latter case, the module may be placed within a pocket formed in the inflatable body. Such pocket may include a fold over portion adapted to secure the module within the pocket. Further, the module may include a speaker for producing the audio signal or a light for producing the visual signal. The module may further include a motion sensor, which may be in the form of an infrared transmitter/receiver. In other embodiments, the module may include at least one light and/or two infrared transmitter/receivers. A vibration sensor may also be provided for waking up the circuitry of the module upon detection of vibration.

Another aspect of the present invention is a method of constructing a playland. Such method may include the steps of providing an inflatable body, blowing up the inflatable body, providing a module capable of playing a sound and/or displaying a visual upon detection of an object within or near the inflatable body and connecting the module to the inflatable body. In addition, the blowing up step may include blowing up one or more portions of the inflatable body. Likewise, the connecting step may include placing the module within a pocket formed in the inflatable body.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

Figure 1:
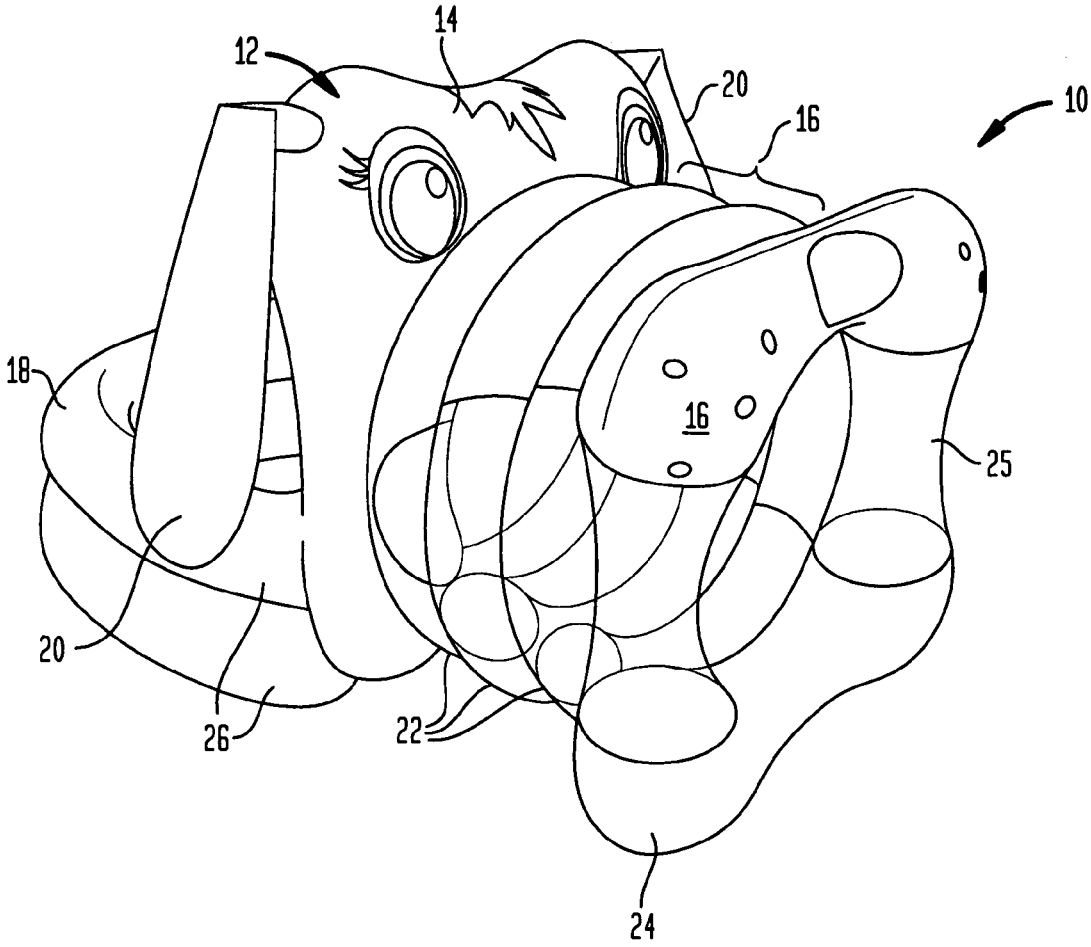
FIG. 1 is a front perspective view of a playland in accordance with one embodiment of the present invention.
Figure 2:
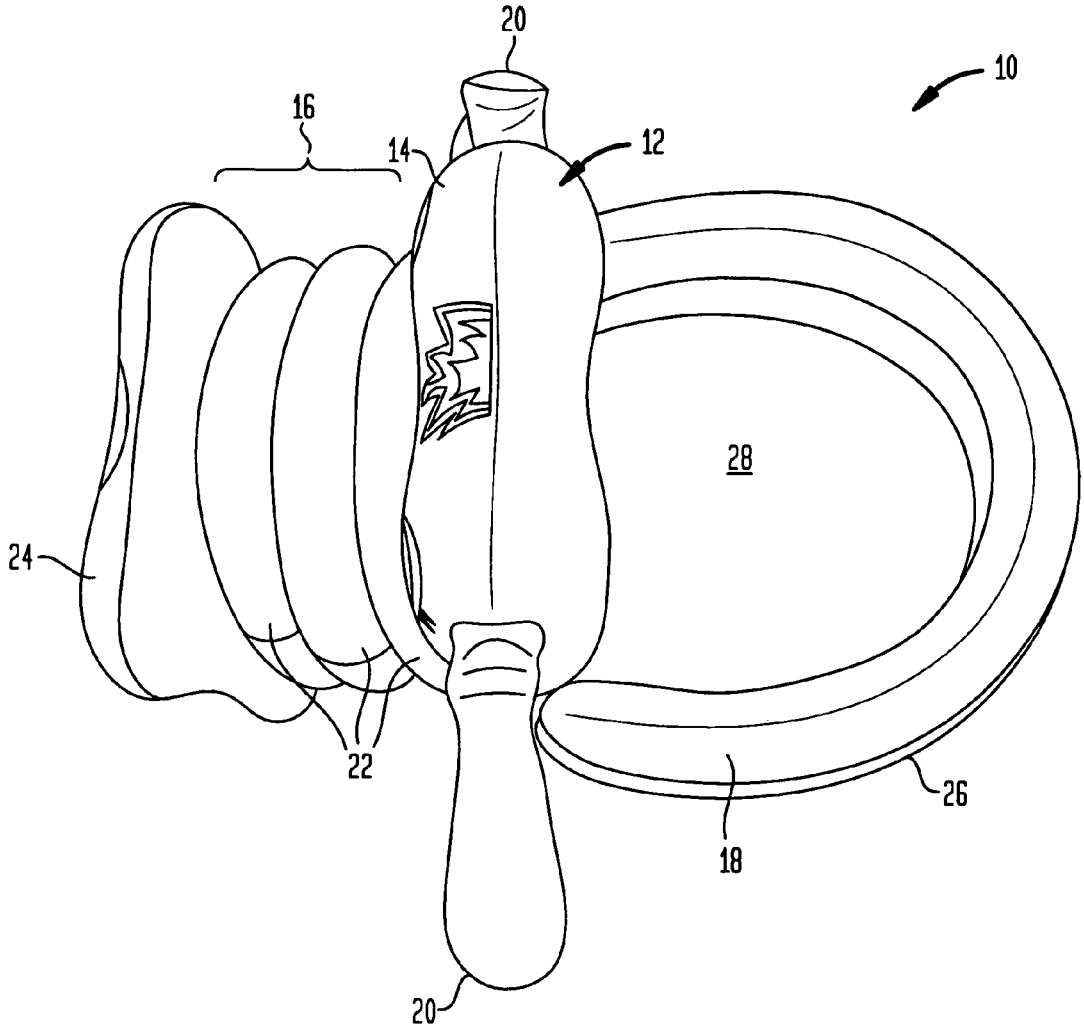
FIG. 2 is a top perspective view of the playland of FIG. 1.
Figure 3:
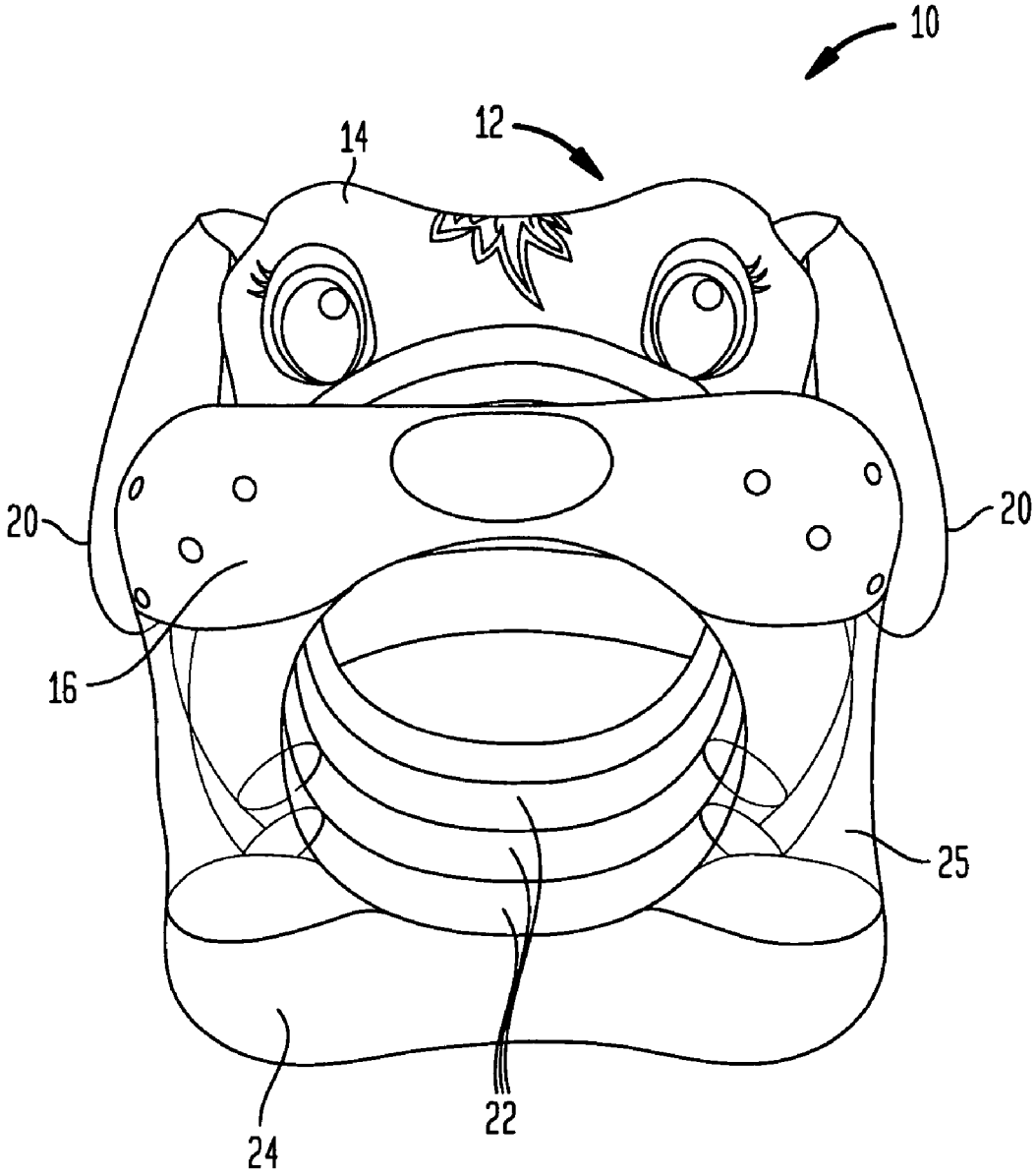
FIG. 3 is a front view of the playland of FIG. 1.
Figure 4:
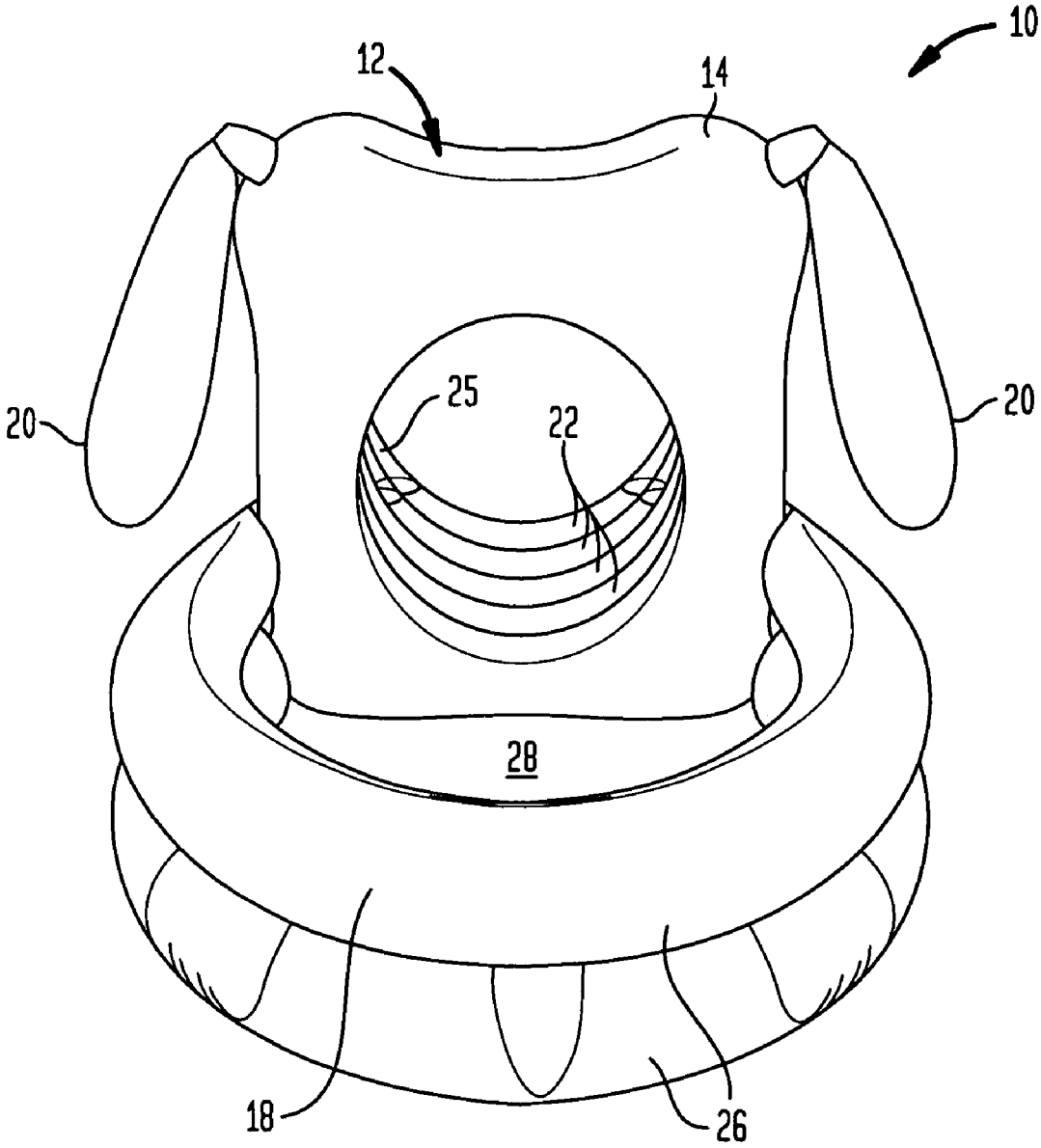
FIG. 4 is a rear view of the playland of FIG. 1.
Figure 5:
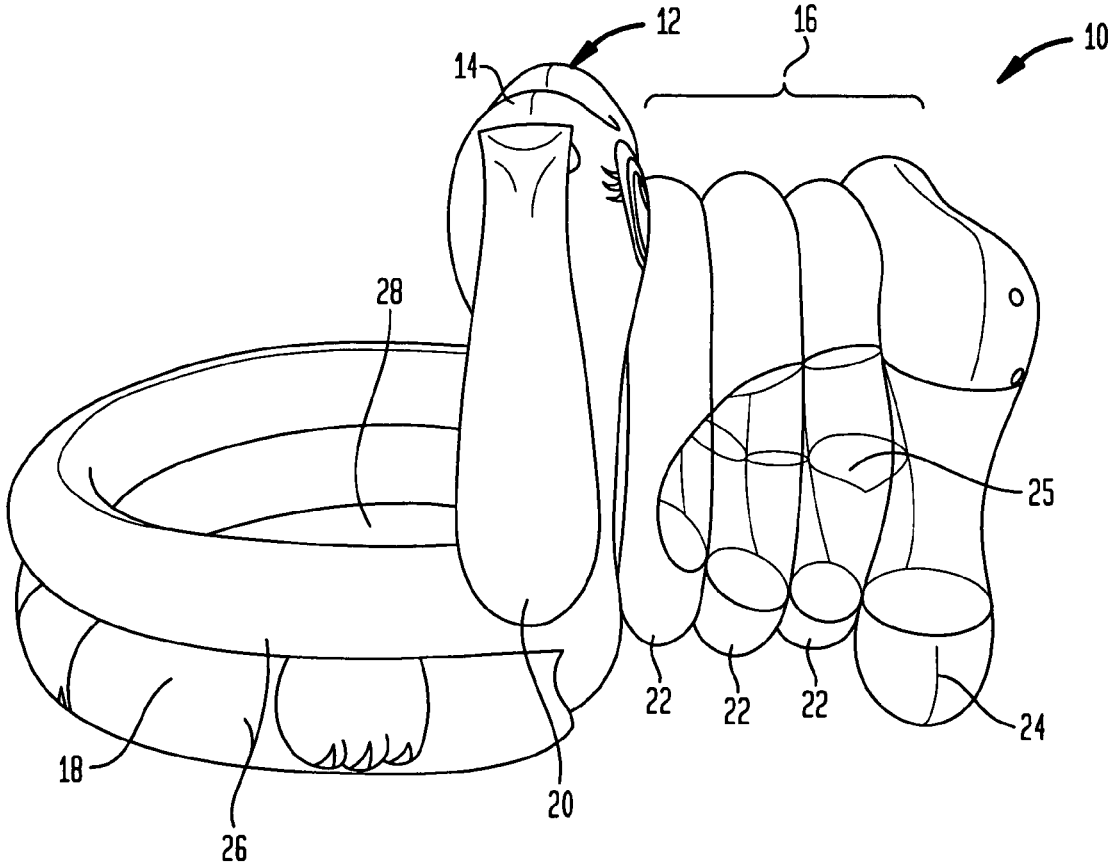
FIG. 5 is a side perspective view of the playland of FIG. 1.

Referring to the drawings wherein like reference numerals refer to like elements, there is shown in FIGS. 1-5, in accordance with one embodiment of the present invention, an inflatable children's toy or playland designated generally by reference numeral 10. In the embodiment shown in FIGS. 1-5, playland 10 is designed to emulate a puppy or dog, and preferably includes a body 12 capable of being inflated and deflated. This body is preferably constructed of a material suitable for allowing the inflatable characteristics, such as a polymeric material capable of being expanded. The inflatable nature of body 12 preferably allows for playland 10 to be rather large in its inflated state, while at the same time rather compact in its deflated state.

Body 12 of playland 10 is preferably designed so as to provide the aforementioned puppy or dog shape, thereby defining a head portion 14 flanked by a tunnel portion 16 and a recessed portion 18. Head portion 14 may include ear portions 20 and other indicia for further aesthetically representing the dog. Of course, when other things are to be emulated, such elements may widely vary. Tunnel portion 16 is preferably sized and configured for a child to pass therethrough. As shown in FIGS. 1-5, tunnel portion 16 includes a series of typically inflatable concentric sections 22 connected with head portion 14 on one side and with an entrance section 24 on the other side. This design preferably provides support for a child within tunnel portion 16. In addition, tunnel portion 16 may include one or more transparent or translucent sections 25 providing visualization into the tunnel. These may allow the child to see out, as well as for a parent or guardian to see in. Finally, recessed portion 18 is designed to provide a pool like structure connected with tunnel portion 16. In fact, in certain embodiments, recessed portion 18 may allow for water or other liquid to be contained therein. In a similar fashion to that of tunnel portion 16, recessed portion 18 may include more than one concentric sections 26 to provide stability to the portion. A floor section 28 (best shown in FIG. 2) may also be provided to contain liquid within recessed portion 18. Of course, in designs not adapted to hold a liquid, such a floor section 28 may not be necessary. It is noted that each portion or smaller areas of each portion of playland 10 may be individually inflatable separate from the other portions or areas.

Figure 17:
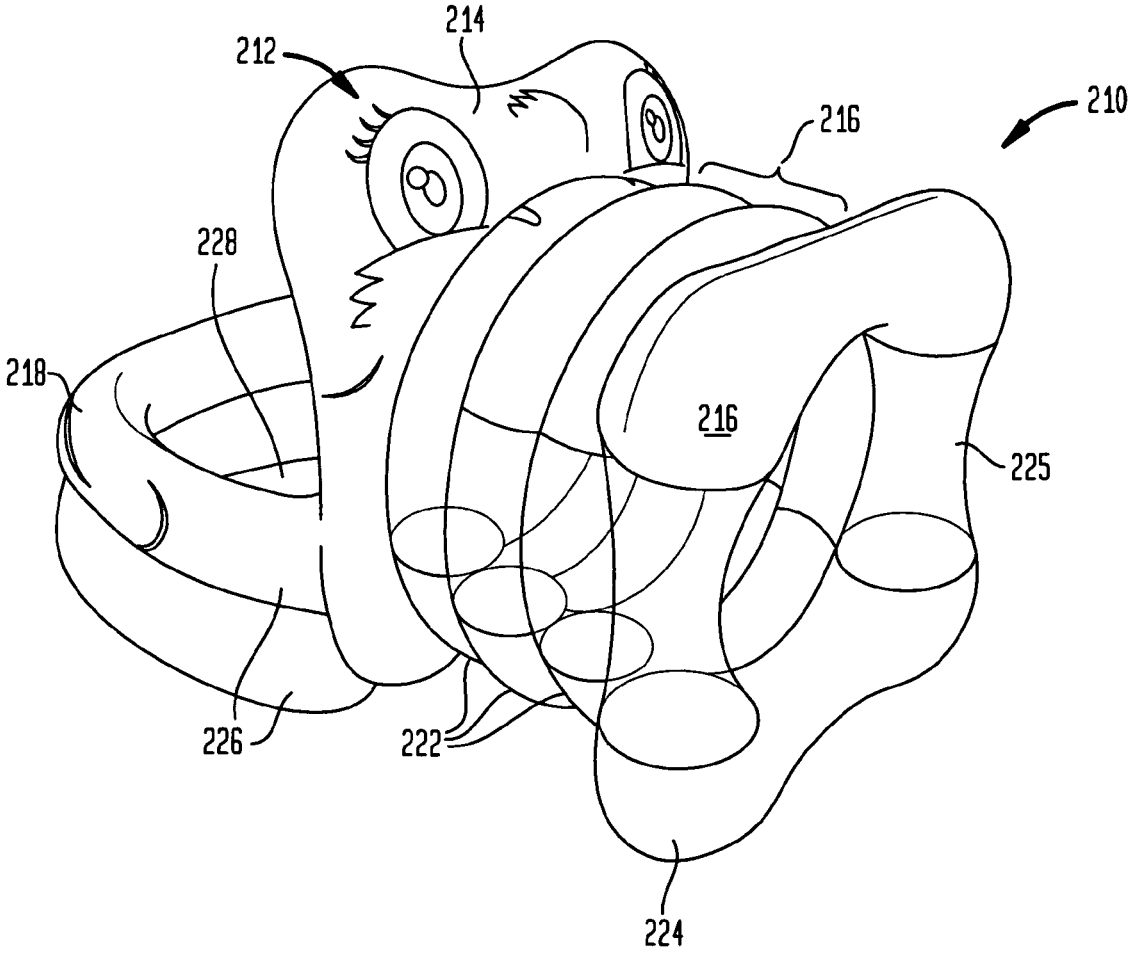
FIG. 17 is a front perspective of a playland in accordance with another embodiment of the present invention.
Figure 18:
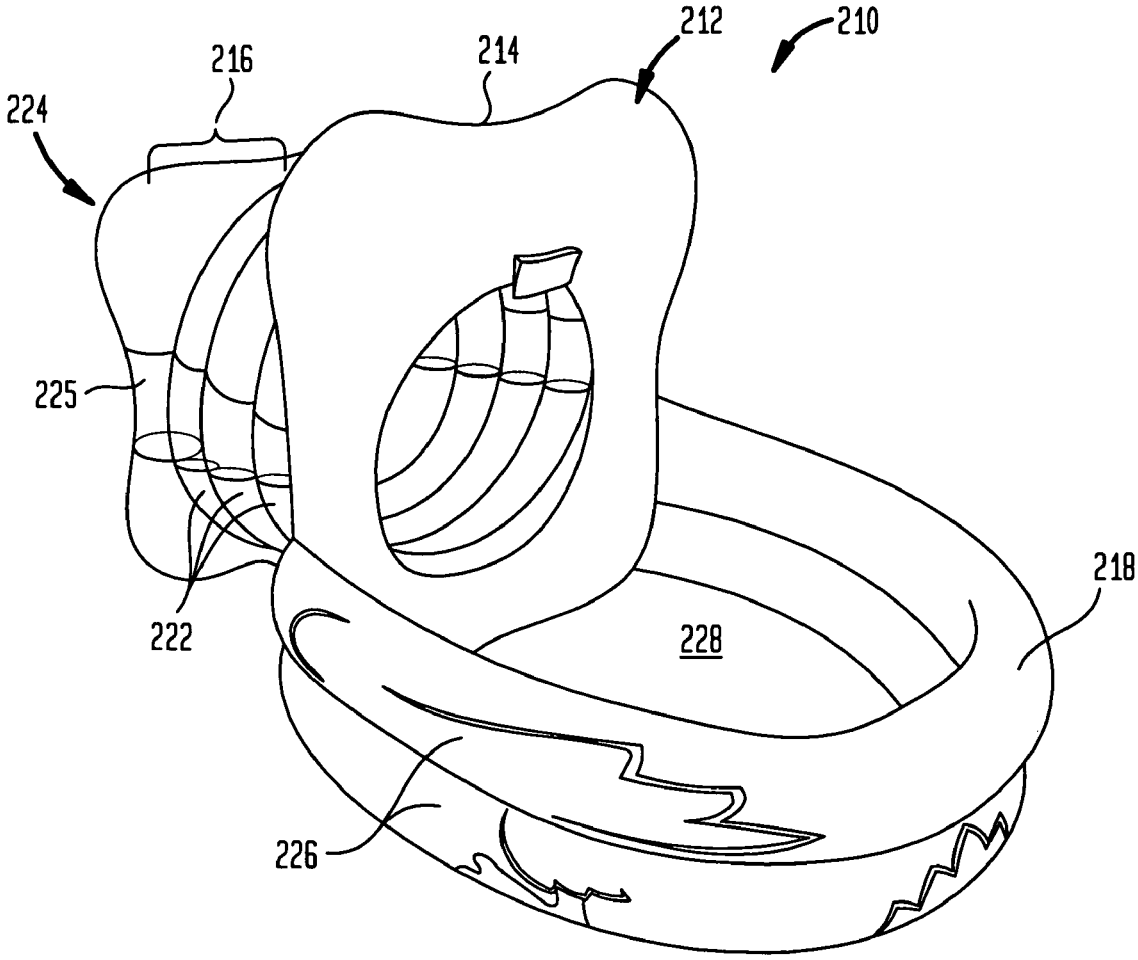
FIG. 18 is a rear perspective of the playland of FIG. 17.

During play, a child is preferably allowed to venture through tunnel portion 16, through head portion 14 and into recessed portion 18. In embodiments where recessed portion 18 is designed to hold water or another liquid, endless fun can be had going from a dry area outside tunnel portion 16 and ultimately into recessed portion 18. Depending upon the target age for playland 10, the structure may be sized accordingly. For example, a playland designed for toddlers in accordance with the present invention could be sized smaller than one for older children. In addition, as is briefly mentioned above, other playland designs may be provided in accordance with the present invention. In fact, playland 10 could be designed to emulate any object, animal or theme. For instance, FIGS. 17 and 18 show a playland 210 in accordance with another embodiment of the present invention, designed to imitate a duck with similar features labeled with similar 200-series numbers. Many other aesthetic designs may also be employed.

Figure 6:
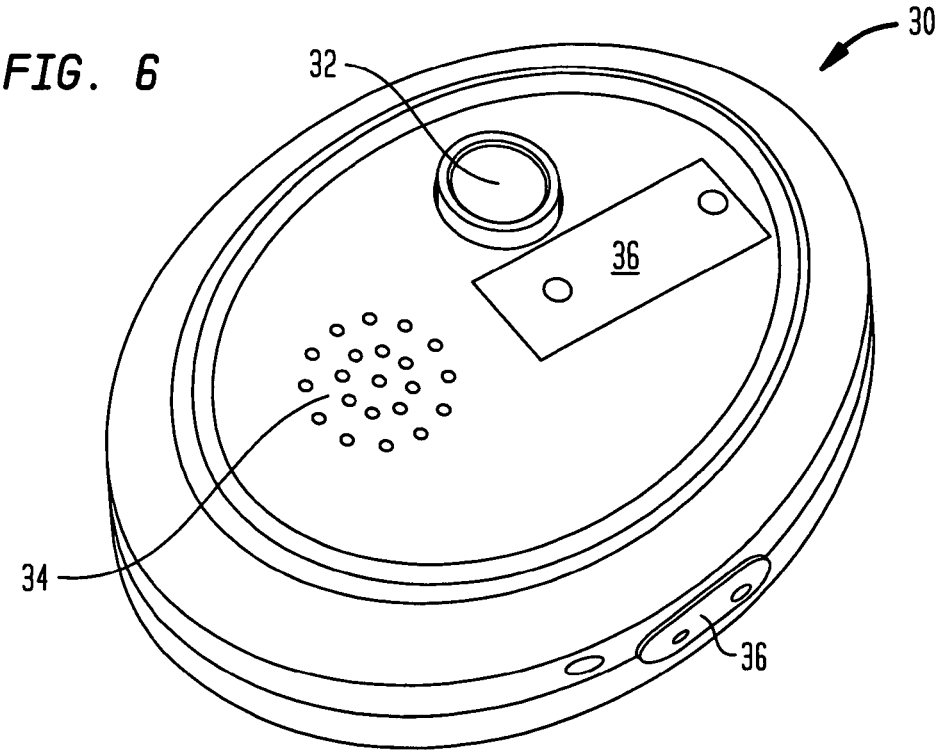
FIG. 6 is a top perspective view of a sensor module for use with the playland of FIG. 1.
Figure 7:
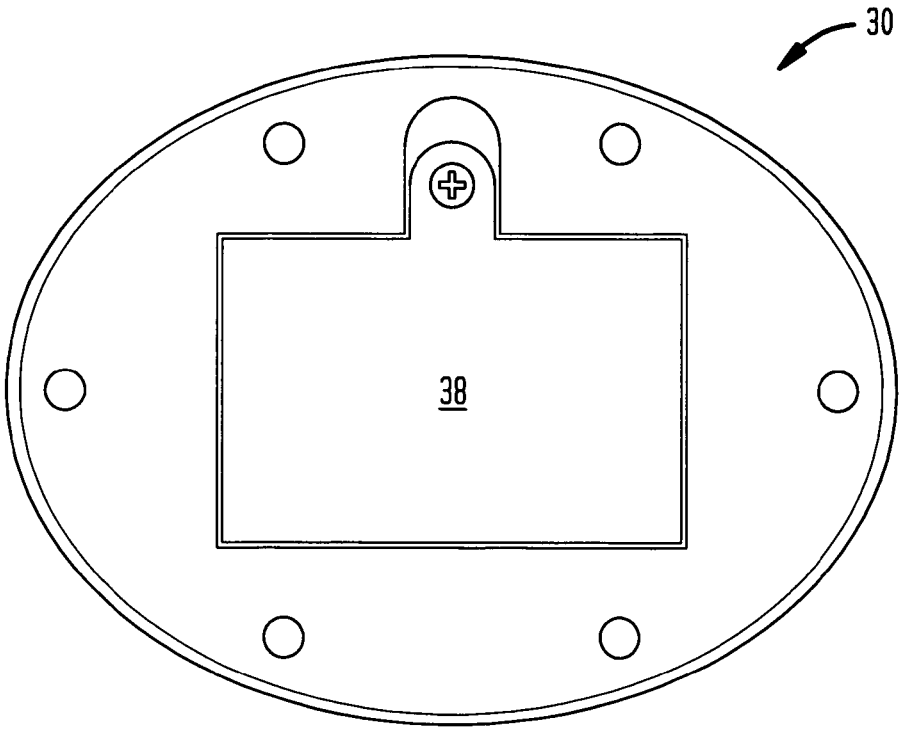
FIG. 7 is a bottom view of the sensor module of FIG. 6.

In addition to the useful design of playland 10 described above, such apparatus may also include a sensor module, such as sensor module 30 shown in FIGS. 6 and 7. Playing with playland 10 is preferably enhanced by utilizing a module such as module 30. In accordance with the present invention, such a module may provide for the activation of light and/or sound upon some action on the part of the user (child) of playland 10. This will be discussed more fully below.

Figure 8:
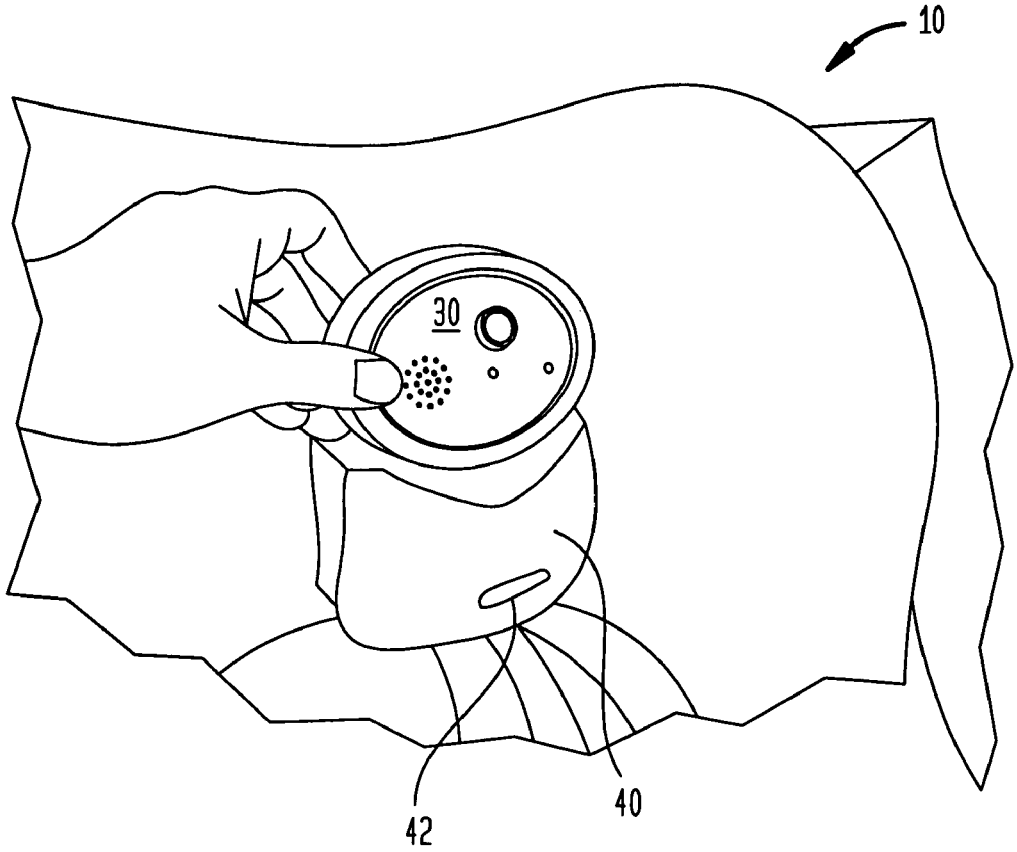
FIG. 8 illustrates the placement of the sensor module of FIG. 6 within the playland of FIG. 1.
Figure 9:
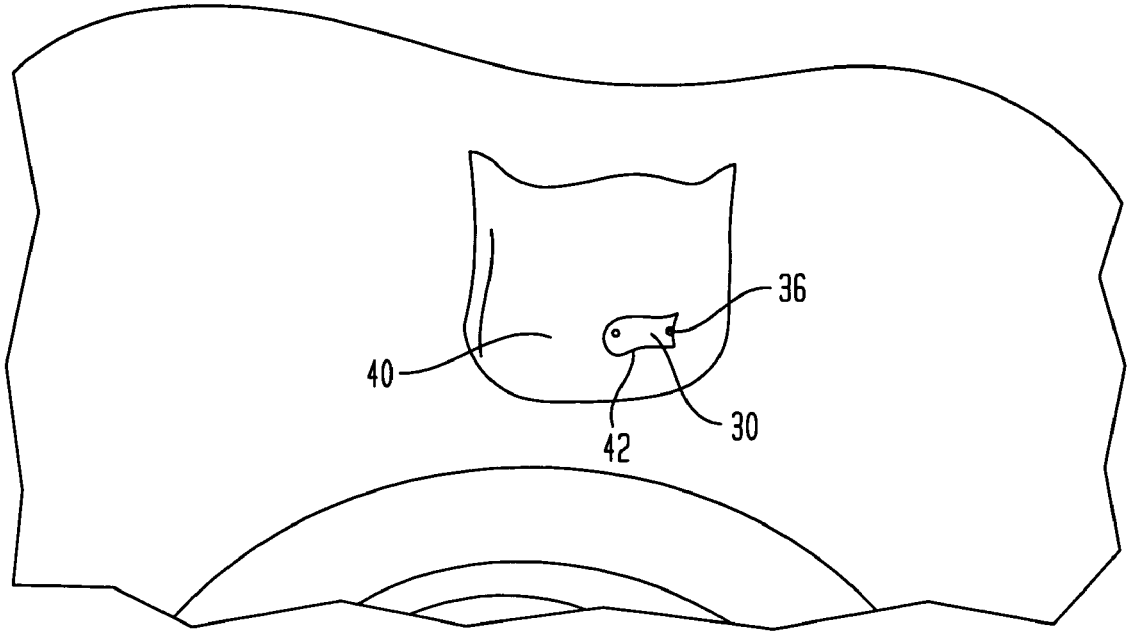
FIG. 9 depicts the sensor module of FIG. 6 placed within the playland of FIG. 1.
Figure 10:
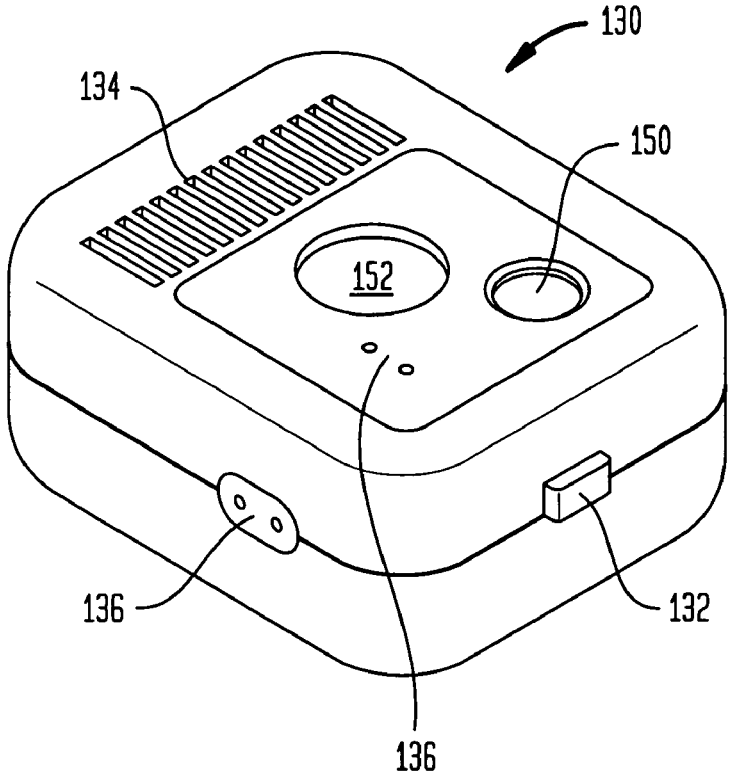
FIG. 10 is a top perspective view a sensor module according to another embodiment of the present invention.
Figure 11:
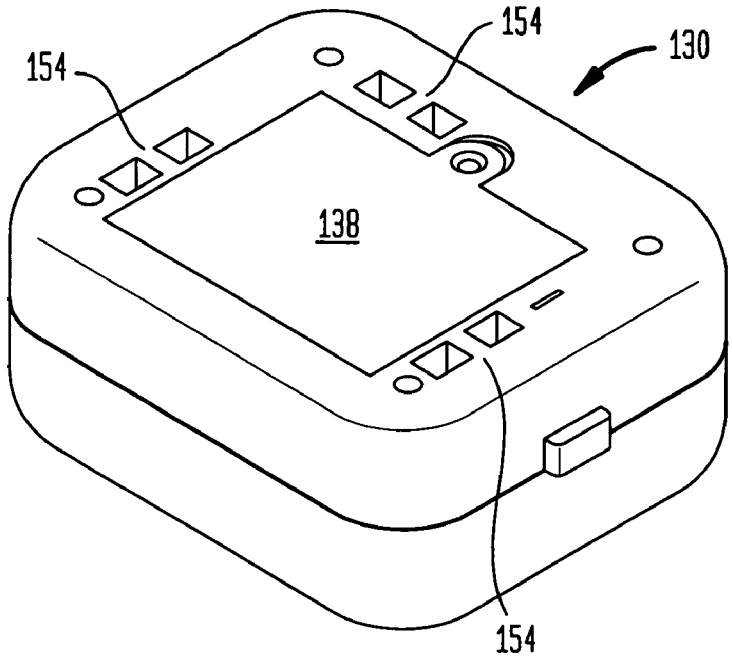
FIG. 11 is a bottom perspective view of the sensor module of FIG. 10.

As is shown in FIGS. 6 and 7, sensor module 30 is an independent element and preferably includes an on/off switch 32, a speaker 34, and one or more transmitter/receiver combinations 36, among other elements. In addition, as is best shown in FIG. 7, module 30 preferably includes a power source such as a battery (not shown) held within module 30 by a cover 38 or the like. FIGS. 8 and 9 depict the placement of module 30 with respect to playland 10. Specifically, module 30 is preferably placed within a pocket 40 formed on the top of one side of head portion 14. At least one aperture 42 may be provided within pocket 40, so as to allow at least one of the transmitter/receiver combinations 36 of module 30 to be exposed through the pocket. Such aperture(s) 42 may be situated so as to cause transmitter/receiver combination(s) 36 to face a certain way, such as the forward facing direction shown in FIG. 9. Other designs may have combination(s) 36 facing down or may allow more than one combination to be exposed. The fact that module 30 may include more than one combination 36 means that such can easily be adapted to any situation.

Preferably, module 30 is designed to detect any motion at or near the front of transmitter/receiver combination 36. Upon the detection of any such motion, the module preferably plays a sound, displays a visual or both. For example, module 30, as shown in FIGS. 7 and 8, is designed to play music and/or speech upon the detection of motion in front of transmitter/receiver combination 36. The effective distance for the detection of motion of module 30 is preferably from zero to six inches, but clearly may be other ranges depending upon the combination 36 employed by the module. Thus, when a child normally playing with playland 10 passes into or out of tunnel portion 16 transmitter/receiver combination 36 preferably detects same and causes module to play music and/or speech through speaker 34. This necessarily adds to the interactive nature of playland 10 and may prevent a child from becoming quickly tired of same. Further discussion relating to the operation of transmitter/receiver combination 36 is set forth further below.

Figure 12:
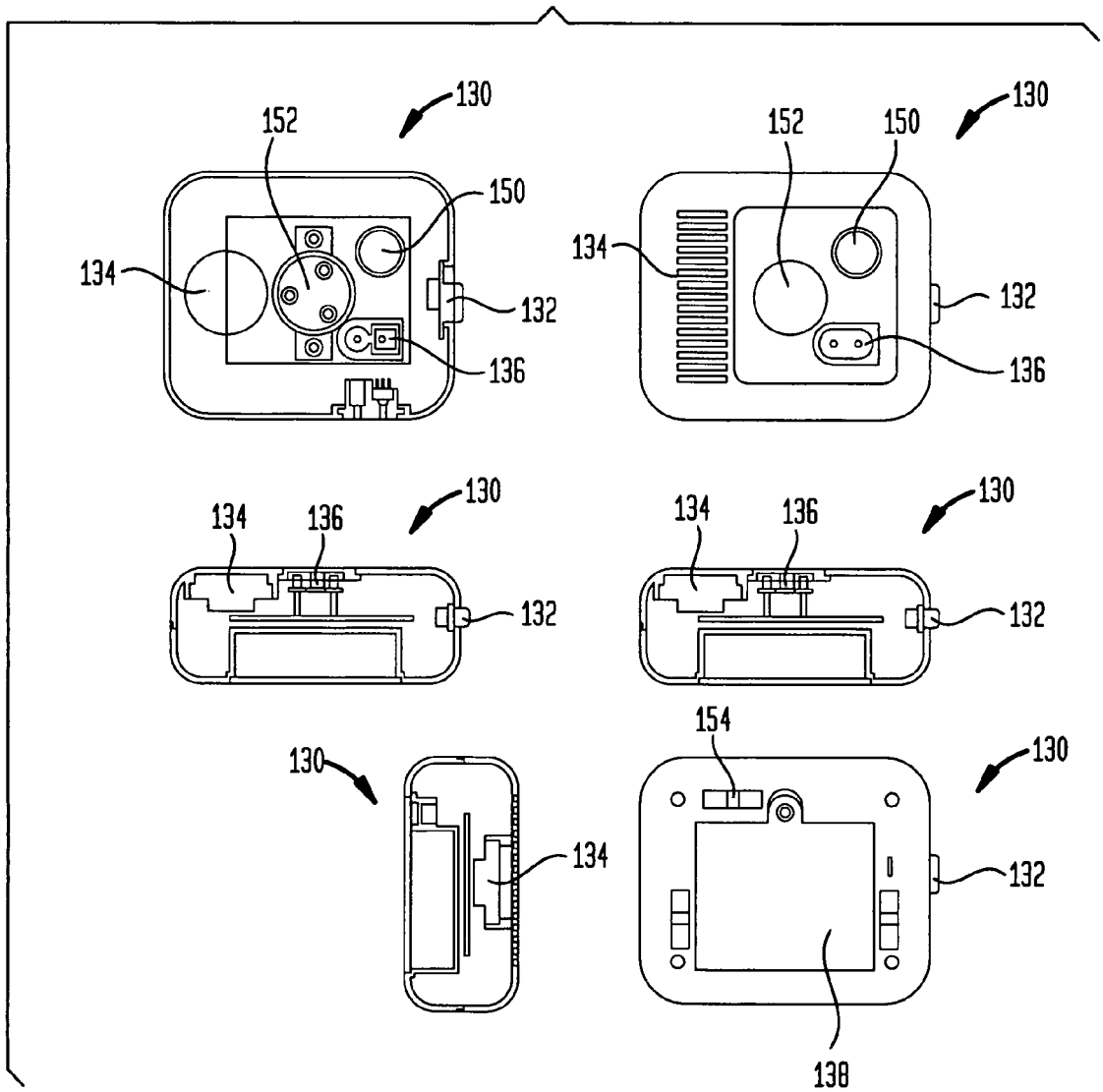
FIG. 12 is a series of illustrations of the sensor module of FIG. 10.
Figure 13:
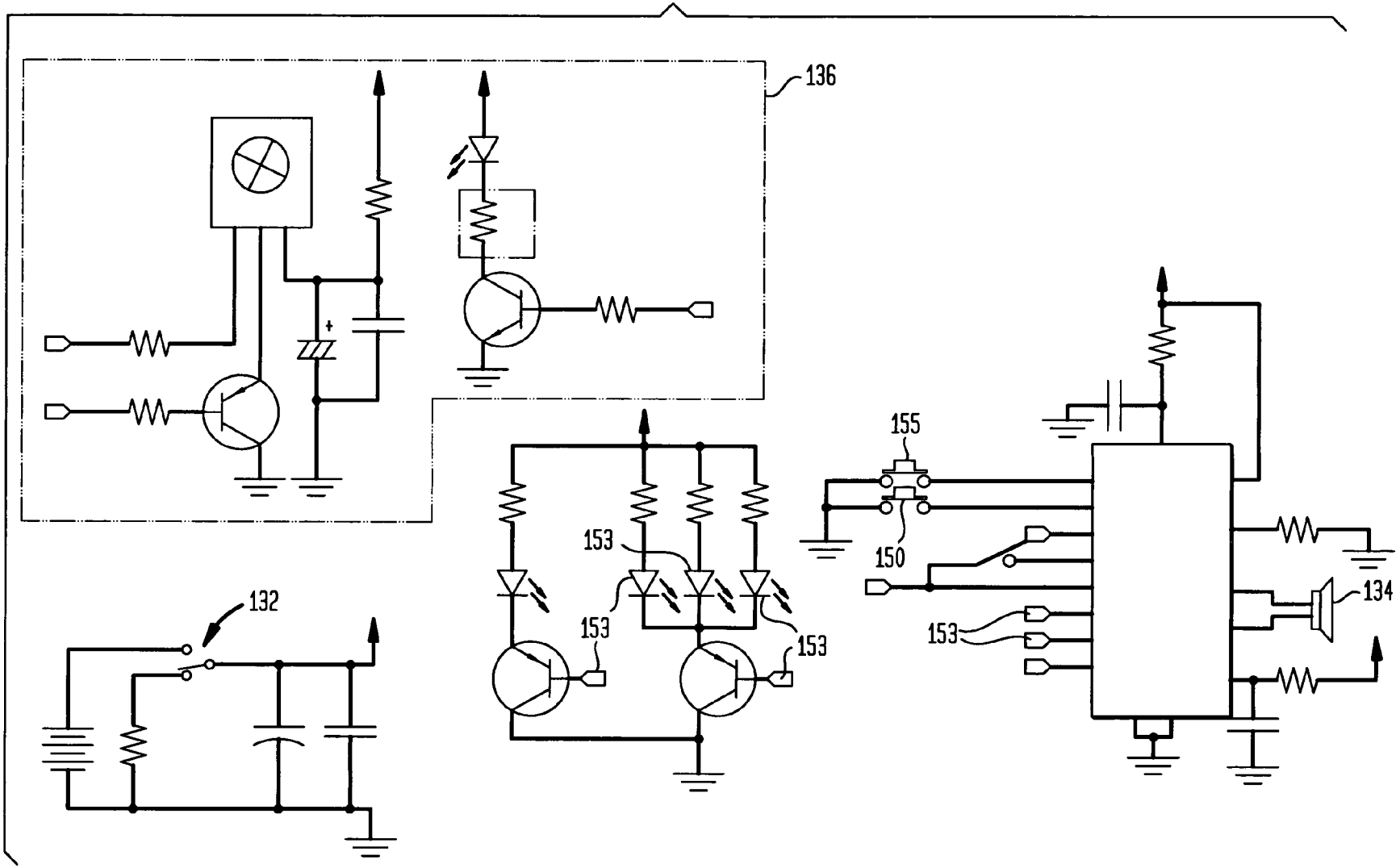
FIG. 13 is a schematic of the circuitry of the sensor module of FIG. 10.

Another embodiment sensor module 130 is depicted in FIGS. 10-13. Essentially, module 130 is similar to above-described module 30, and as such, like elements are labeled with like reference numerals within the 100-series of numbers. For example, module 130 includes an on/off switch 132, a speaker 134, two transmitter/receiver combinations 136, and a cover 138 for retaining a power supply (e.g.—three "AA" batteries). However, module 130 also includes a try me button 150, an LED light window 152 and a plurality of slots 154 formed on the backside of module 130. These slots 154 are preferably designed so as to aid in retaining module 130 within a package through the use of ties or the like. Likewise, try me button 150 is preferably capable of allowing a person to test the operation of module 130 while such is retained within a package. Finally, LED light window 152 is designed to provide a visual stimulus upon detection of movement by either combination 136. Preferably, module 130 includes one or more lights 153 (shown best in FIG. 12) aligned with window 152, such that upon detection of motion, the lights are caused to flash. This is preferably in addition to speaker 134 dispensing music and/or speech at the same time. FIG. 12 further illustrates and depicts module 130. FIG. 13 shows circuit diagrams for various electrical interconnections of on/off switch 132, lights 153, speaker 134, try-me switch 150, infared transmitter/receiver 136 and vibration switch 155.

Figure 14:
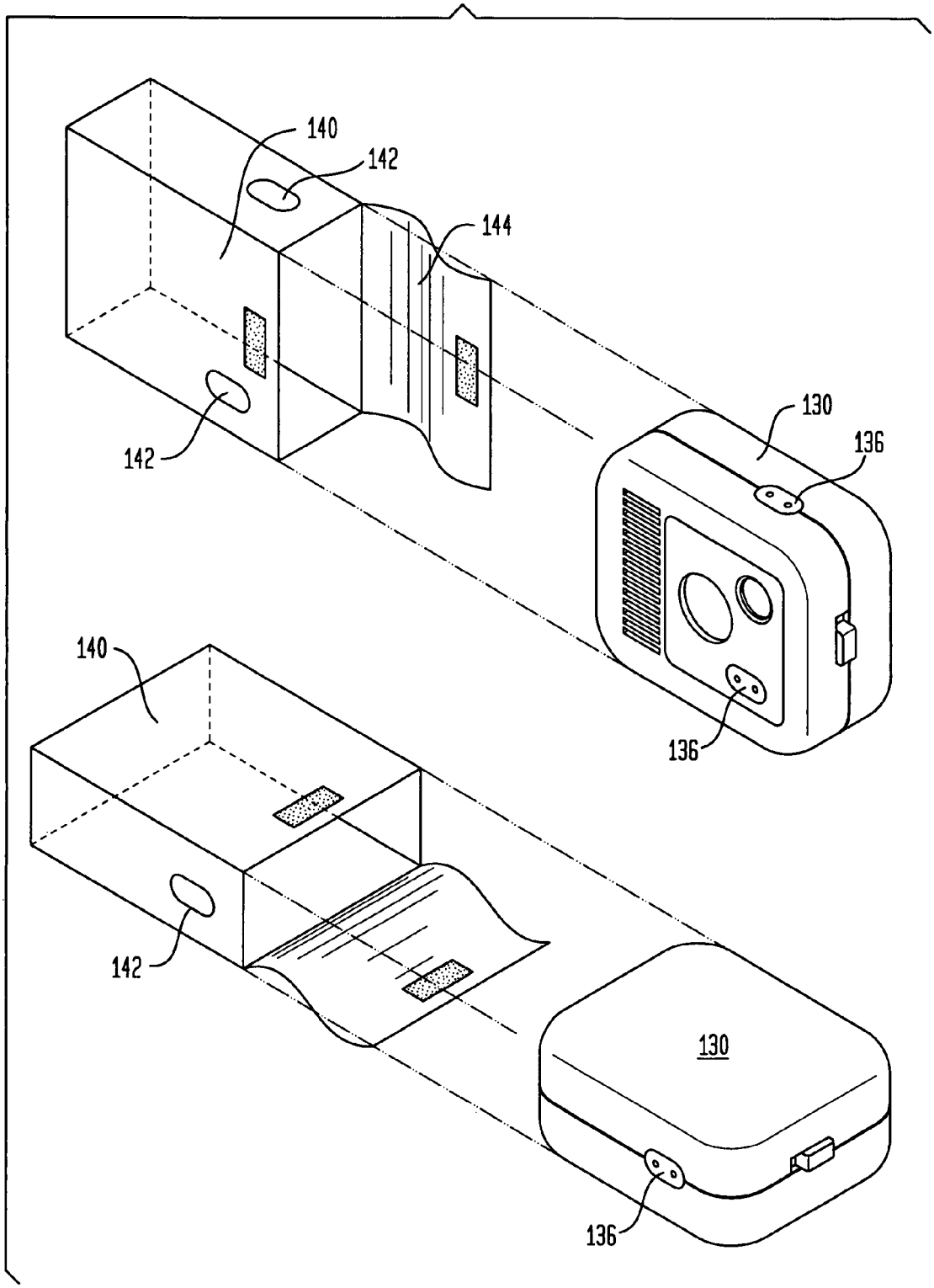
FIG. 14 is an illustration depicting two different placements of the sensor module of FIG. 10.

FIG. 14 depicts the placement of module 130 within a pocket 140. This pocket 140 is similar to pocket 40 in that it is designed to hold the module and may include an aperture 142, but pocket 140 also preferably includes a fold over portion 144 having an attachment mechanism for attaching to the main body of the pocket. For example, as is shown in the drawing, fold over portion 144 includes Velcro for attaching to like Velcro located on the main body of pocket 140. Of course, other attachment mechanisms may be employed, such as snaps, zippers or the like. This design preferably secures module 130 within pocket 140 without fear of such falling out. As such, module 130 may be disposed sideways rather than simply up and down within pocket 140. It is noted that two different placements are shown in FIG. 14, a sideways placement and a flat placement. In each placement, aperture or hole 142 is situated differently so as to allow proper operation of transmitter/receiver combination 136.

Both modules 30 and 130 can have transmitter/receiver combinations located at any portion thereon. The placement of such clearly dictates how the particular module is placed within a playland such as playland 10. In addition, both modules 30 and 130 may be designed so as to turn off after a set period of inactivity. For example, when no motion if detected for 30 seconds, modules 30 and/or 130 may go into a sleep mode for conservation of power. A vibration sensor 155 (shown in FIG. 13) may be provided in a module in accordance with the present invention, so as to wake up the circuitry of the module without requiring the user to actuate the power switch again. In such a case, any vibration would preferably wake up the particular module. Of course, simple detection of movement may also be designed to cause such circuitry to wake up.

Figure 15:
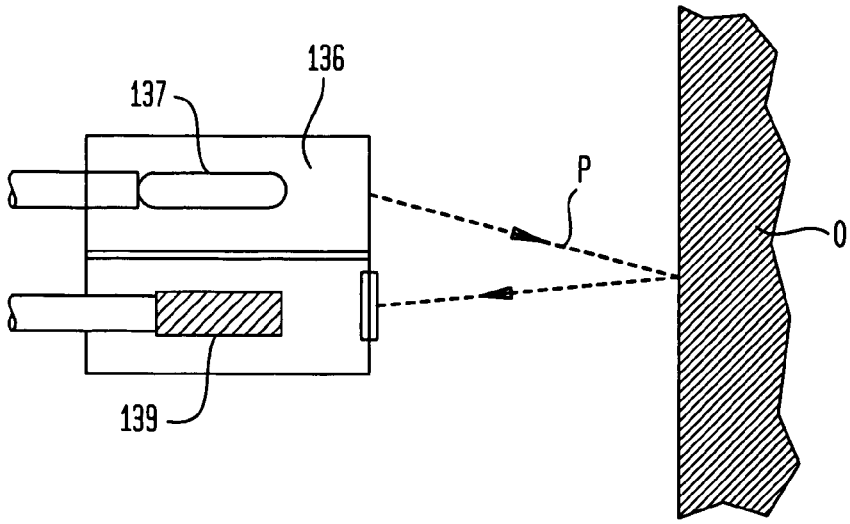
FIG. 15 is an illustration of the operation of an infrared module of the sensor module of FIG. 10.
Figure 16:
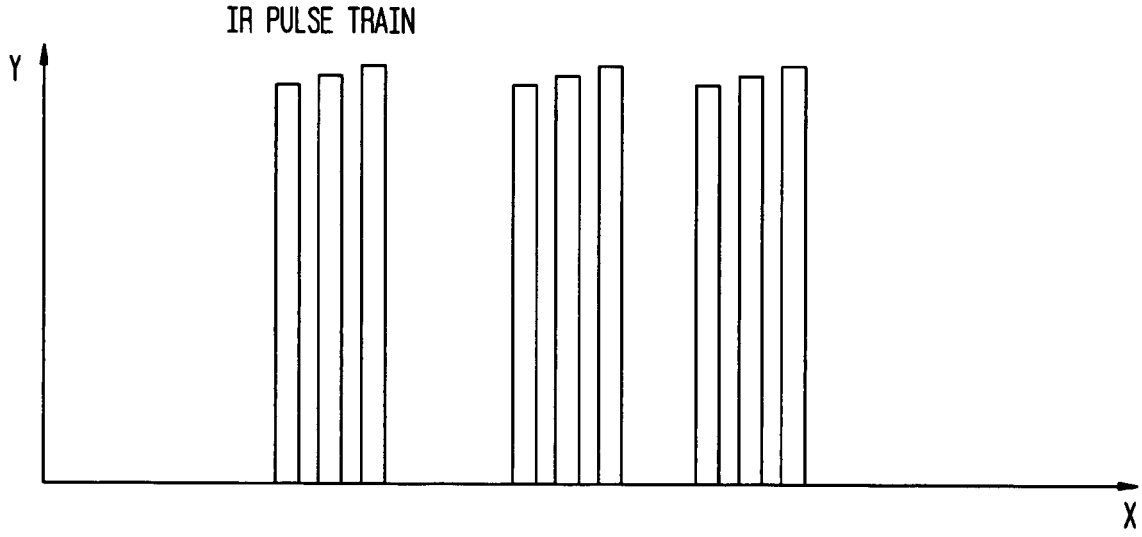
FIG. 16 is an illustration depicting the infrared pulse train of the infrared module of FIG. 15.

FIG. 15 illustrates typical operation of a transmitter/receiver combination for use with a module in accordance with the present invention. Preferably, both an infrared ("IR") transmitter 137 and receiver 139 are mounted in a combination 36 or 136. When such combination is in a motion detection mode, the IR transmitter 137 is preferably continuously sending out encoded IR pulse trains P (depicted graphically in FIG. 16 with time along the X-axis of the graph and the intensity of the IR light emitted by transmitter 137 along the Y-axis of the graph) at a certain angle (see FIG. 15). If someone or some other obstacle O appears in front of the transmitter/receiver combination, the IR pulses will be reflected to the IR receiver. Thus, the transmitter/receiver combination will be triggered and will cause module 30 or 130 to play sounds and/or display lights. Preferably, the transmitter/receiver combination is colored black and enclosed appropriately to isolate the transmitter and receiver form any direct optical interference between each other.

Thus, in accordance with the present invention, a playland 10 is provided which is designed to allow play therein or around, and which includes a sensing device that, upon detection of movement, plays a sound and/or displays a visual. Clearly, in the field of children's toys, this provides an improvement upon other known toys. The inclusion of a separate module with the inflatable playland makes the present invention easy to package and store. Of course, in certain embodiments, a module, such as module 30 or 130, may be formed integrally with playland 10 or the like. Those of ordinary skill in the art would readily recognize the different variations that can be made to the invention described herein.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A playland for use by a person comprising:

an inflatable body having a pocket on an exterior surface of the body; and a unitary module attached to the body, the module including both a motion sensor and being capable of producing a humanly-perceptible signal from said module upon detection of an object within or near the inflatable body by said motion sensor, wherein the module is placed within the pocket.

2. The playland according to claim 1, wherein the humanly-perceptible signal is an audio signal.

3. The playland according to claim 1, wherein the humanly-perceptible signal is a visual signal.

4. The playland according to claim 1, wherein the inflatable body includes a tunnel portion capable of allowing a person to pass therethrough.

5. The playland according to claim 4, wherein the inflatable body further includes a head portion connected to the tunnel portion and a recessed portion connected to the head portion.

6. The playland according to claim 1, wherein the inflatable body is designed to emulate an animal.

7. The playland according to claim 1, wherein the pocket includes a fold over portion adapted to secure the module within the pocket.

8. The playland according to claim 1, wherein the module includes a speaker.

9. The playland according to claim 8, wherein the module further includes at least one light.

10. The playland of claim 1, wherein the motion detector is in the form of an infrared transmitter/receiver.

11. The playland according to claim 10, wherein the module includes two infrared transmitter/receivers.

12. The playland according to claim 1, wherein the module includes a vibration sensor.

13. The playland according to claim 12, wherein the vibration sensor is adapted to change an operational state of the module from a sleep mode to an active mode.

14. The module of claim 13, wherein the module includes a switch adapted to change the operative state of the module from the active mode to the sleep mode.

15. The module of claim 13, wherein the module includes a timer adapted to change the operative state of the module from the active mode to the sleep mode after a predetermined amount of time.

16. A playland for use by a person comprising:

an inflatable body having a pocket, said body including first and second spaced apart ends each having an opening, a plurality of concentric sections connecting said first and second sections, said concentric sections forming a tunnel communicating between said openings of said first and second ends; and a unitary module attached to said body, said module including both a motion sensor and being capable of producing a humanly-perceptible signal from said module upon detection of an object with or near said opening of said first end of said body by said motion sensor, wherein the module is placed within the pocket.

17. The playland of claim 16, wherein said body further includes a recessed portion attached to said second end of said body.

18. The playland of claim 17, where said recessed portion comprises a plurality of concentric sections.

19. The playland of claim 18, wherein said concentric sections of said recessed portion are inflatable.

20. The playland of claim 18, wherein said recessed portion further includes a floor section whereby said recessed portion is capable of holding a liquid.

21. The playland of claim 16, where said concentric sections are inflatable.

22. The playland according to claim 18, wherein the pocket includes a fold over portion adapted to secure the module within the pocket.

23. The playland according to claim 16, wherein the module includes a speaker.

24. The playland according to claim 23, wherein the module further includes at least one light.

25. The playland according to claim 16, wherein the module includes a vibration sensor.

26. A playland for use by a person comprising:

an inflatable body having a pocket on an exterior surface of the body; and a unitary module attached to the body, the module comprising a motion sensor and a speaker forming said unitary module for producing humanly-perceptible sounds from said speaker upon detection of an object within or near the inflatable body by the motion sensor, wherein the module is placed within the pocket.

27. The playland according to claim 26, wherein the unitary module further includes at least one light source for producing humanly-perceptible light upon detection of an object within or near the inflatable body by the motion sensor.

* * * * *